US006935795B1

(12) United States Patent
Fagan et al.

(10) Patent No.: US 6,935,795 B1
(45) Date of Patent: Aug. 30, 2005

(54) METHOD FOR REDUCING THE EFFECTS OF PRINTHEAD CARRIER DISTURBANCE DURING PRINTING WITH AN IMAGING APPARATUS

(75) Inventors: Mark Walter Fagan, Lexington, KY (US); Frederick Charles Griesemer, Lexington, KY (US); Michael Anthony Marra, III, Lexington, KY (US); Randall David Mayo, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 1 day.

(21) Appl. No.: 10/802,560

(22) Filed: Mar. 17, 2004

(51) Int. Cl.[7] ..... B41J 19/00
(52) U.S. Cl. ..... 400/283; 347/37
(58) Field of Search ..... 400/283; 347/5, 347/37

(56) References Cited

U.S. PATENT DOCUMENTS

| | | | | |
|---|---|---|---|---|
| 5,433,541 | A * | 7/1995 | Hieda et al. | 400/279 |
| 5,527,121 | A * | 6/1996 | Santon | 400/323 |
| 5,547,295 | A * | 8/1996 | Kanemitsu | 400/279 |
| 5,871,291 | A | 2/1999 | Kawazoe | |
| 5,997,130 | A * | 12/1999 | Bolash et al. | 347/37 |
| 6,086,181 | A | 7/2000 | Majette et al. | |
| 6,139,205 | A | 10/2000 | Suzuki et al. | |
| 6,158,905 | A * | 12/2000 | Endo | 400/76 |
| 6,203,139 | B1 * | 3/2001 | Beauchamp | 347/37 |
| 6,257,686 | B1 | 7/2001 | Takahashi et al. | |
| 6,293,639 | B1 | 9/2001 | Isamoto | |
| 6,296,340 | B1 | 10/2001 | Tajika et al. | |
| 6,297,888 | B1 | 10/2001 | Noyes et al. | |
| 6,312,098 | B1 | 11/2001 | Miquel et al. | |
| 6,336,701 | B1 | 1/2002 | Hickman | |
| 6,336,702 | B1 | 1/2002 | Zapata et al. | |
| 6,416,147 | B1 | 7/2002 | Li et al. | |
| 6,505,905 | B1 * | 1/2003 | Krouss | 347/15 |
| 6,523,936 | B2 | 2/2003 | Zapata et al. | |
| 6,547,362 | B2 | 4/2003 | Subirada et al. | |
| 6,554,395 | B2 | 4/2003 | Cole et al. | |
| 6,565,171 | B2 | 5/2003 | Miquel et al. | |
| 6,595,613 | B2 | 7/2003 | Fujimori | |
| 6,595,621 | B2 | 7/2003 | Castano et al. | |
| 6,607,261 | B1 | 8/2003 | Shimada | |
| 6,629,751 | B2 | 10/2003 | Giere et al. | |
| 2001/0043338 | A1 * | 11/2001 | Williams et al. | 358/1.5 |
| 2002/0085050 | A1 * | 7/2002 | Aruga et al. | 347/7 |
| 2002/0111707 | A1 * | 8/2002 | Li et al. | 700/118 |
| 2002/0158927 | A1 | 10/2002 | Kojima | |
| 2002/0158935 | A1 | 10/2002 | Tatsumi | |

(Continued)

FOREIGN PATENT DOCUMENTS

| | | | | |
|---|---|---|---|---|
| EP | 0661167 | A2 * | 7/1995 | B41J 19/18 |

(Continued)

*Primary Examiner*—Charles H. Nolan, Jr.
(74) *Attorney, Agent, or Firm*—Taylor & Aust P.C.

(57) ABSTRACT

A method for reducing the effects of printhead carrier disturbance during printing with an imaging apparatus having a printhead carrier for carrying at least one printhead includes the steps of accelerating the printhead carrier from a first position in a first direction; printing with the printhead in the first direction; and changing a rate of acceleration of the printhead carrier for a subsequent accelerating of the printhead carrier from the first position in the first direction prior to a subsequent printing with the printhead in the first direction to phase shift the printhead carrier disturbance.

33 Claims, 6 Drawing Sheets

U.S. PATENT DOCUMENTS

2002/0171702 A1 11/2002 Kobayahsi et al.
2003/0025749 A1 * 2/2003 Krouss ..... 347/15
2003/0085936 A1 5/2003 Tanaka
2003/0122889 A1 7/2003 Okuda
2003/0146742 A1 8/2003 Nishida et al.
2003/0146947 A1 8/2003 Ozaki et al.
2004/0135833 A1 * 7/2004 Mitsuzawa ..... 347/12

FOREIGN PATENT DOCUMENTS

GB 2345666 A * 7/2000 ..... B41J 19/20
JP 2003182059 A * 7/2003 ..... B41J 2/01

* cited by examiner

METHOD FOR REDUCING THE EFFECTS OF PRINTHEAD CARRIER DISTURBANCE DURING PRINTING WITH AN IMAGING APPARATUS

BACKGROUND OF THE INVENTION

1. Field of the Invention

The present invention relates to an imaging apparatus, and, more particularly, to a method for reducing the effects of printhead carrier disturbance during printing with an imaging apparatus.

2. Description of the Related Art

An imaging apparatus may be, for example, a printer or a multifunction unit. Such a printer may be, for example, an ink jet printer having an ink jet print engine. Such a multifunction unit may include an ink jet print engine, and is configured to perform standalone functions, such as copying or facsimile receipt and transmission.

Typically, an imaging apparatus having an ink jet print engine includes a reciprocating printhead carrier that transports one or more ink jet printheads across the print medium along a bi-directional main scanning direction, also commonly referred to as the horizontal direction. Printing may take place during one or more unidirectional scans, i.e., passes, of the printhead carrier, e.g., a left-to-right scan and/or a right-to-left scan.

An image is formed on a print medium by ejecting ink from at least one ink jet printhead to form a pattern of ink dots on the print medium. Typically, each ink jet printhead will include one or more columnar nozzle arrays, each having a plurality of ink jet nozzles for expelling the ink. In ink jet printing, it is common to use the ink colors of cyan, magenta, yellow and black, in full strength and/or diluted forms, in generating color prints.

An indexing mechanism is used to incrementally advance the print medium in a sheet feed direction, also commonly referred to as a sub-scan direction or vertical direction, through a printable region (also sometimes referred to as a print zone) between passes of the printhead carrier in the main scanning direction, or after all data intended to be printed on the print medium has been completed.

One type of printing defect common to ink jet print engines is often referred to as vertical banding. Vertical banding defects in multi-color printing are typically observed as a repeating pattern of vertical light bands and vertical dark bands in a printed image, and may also appear in multi-color form similar to that of a rainbow. Vertical banding may also appear in a more rainbow-like repeating pattern. In either case, the printing defect resembles vertical blinds or bands. Vertical banding defects are particularly noticeable in high density ink jet printer printouts, such as when attempting to produce photographic quality printouts, but also can be observed in lower density printouts as well. It has been recognized that printhead carrier disturbances, in the form of printhead carrier vibration, for example, contribute to vertical banding.

FIG. 1 illustrates the general concept of the printhead carrier disturbance, showing the velocity and carrier disturbance versus carrier position during a printhead carrier movement across the print medium (i.e., in the main scanning or X direction). Waveform 8 depicts printhead carrier velocity, in inches per second (ips). Waveform 9 depicts an exemplary printhead carrier disturbance in terms of generated dot placement error in microns (um) in the sub-scanning direction, i.e., the Y-direction, at a disturbance frequency of 50 hertz (Hz), i.e., with a period of 20 milliseconds (ms). Thus, as the printhead carrier moves across the print medium in the main scanning direction, i.e., the X-direction, the printhead carrier can oscillate, which causes ink dot placement errors in the sheet feed direction, i.e., the Y-direction. This phenomenon is detrimental to print quality, yielding vertical banding and varying grain artifacts.

What is needed in the art is a method for reducing the effects of printhead carrier disturbance during printing with an imaging apparatus.

SUMMARY OF THE INVENTION

The present invention provides a method for reducing the effects of printhead carrier disturbance during printing with an imaging apparatus.

The invention, in one form thereof, relates to a method for reducing the effects of printhead carrier disturbance during printing with an imaging apparatus having a printhead carrier for carrying at least one printhead. The method includes the steps of accelerating the printhead carrier from a first position in a first direction; printing with the printhead in the first direction; and changing a rate of acceleration of the printhead carrier for a subsequent accelerating of the printhead carrier from the first position in the first direction prior to a subsequent printing with the printhead in the first direction to phase shift the printhead carrier disturbance.

In another form thereof, the invention relates to a method for reducing the effects of printhead carrier disturbance during printing with an imaging apparatus having a printhead carrier for carrying at least one printhead. The method includes the steps of: on a present pass of the printhead across a print medium, accelerating the printhead carrier from a first position in a first direction at a first rate of acceleration; printing with the printhead on the present pass; on a subsequent pass of the printhead across the print medium, accelerating the printhead carrier from the first position in the first direction at a second rate of acceleration different from the first rate of acceleration; and printing with the printhead on the subsequent pass.

In still another form thereof, the invention relates to a method for reducing the effects of printhead carrier disturbance during printing with an imaging apparatus having a printhead carrier for carrying at least one printhead. The method includes the steps of defining a printable region for printing on a print medium, said printable region having a print start position and a print end position, said print start position and said print end position defining an extent of said printable region in a main scanning direction of said printhead carrier; defining a carrier start position outside said printable region; on a present pass of said printhead across said print medium, accelerating said printhead carrier from said carrier start position in a first direction toward said print start position at a first rate of acceleration; printing with said printhead on said present pass; on a subsequent pass of said printhead across said print medium, accelerating said printhead carrier from said carrier start position in said first direction toward said print start position at a second rate of acceleration different from said first rate of acceleration; and printing with said printhead on said subsequent pass.

In still another form thereof, the invention relates to an imaging apparatus. The imaging apparatus includes a printhead carrier system configured to drive a printhead carrier carrying at least one printhead along a bi-directional main scanning direction across a print medium. A controller is communicatively coupled to the printhead carrier system. The controller executes instructions to perform the steps of: on a present pass of the printhead across the print medium, accelerating the printhead carrier from a first position in a first direction at a first rate of acceleration; printing with the printhead on the present pass; on a subsequent pass of the printhead across the print medium, accelerating the printhead carrier from the first position in the first direction at a second rate of acceleration different from the first rate of acceleration; and printing with the printhead on the subsequent pass.

An advantage of the present invention is an improvement in printing quality by reducing the effects of printhead carrier disturbance, such as for example, a printhead carrier disturbance vibration that would otherwise result in vertical banding, during printing with an imaging apparatus.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
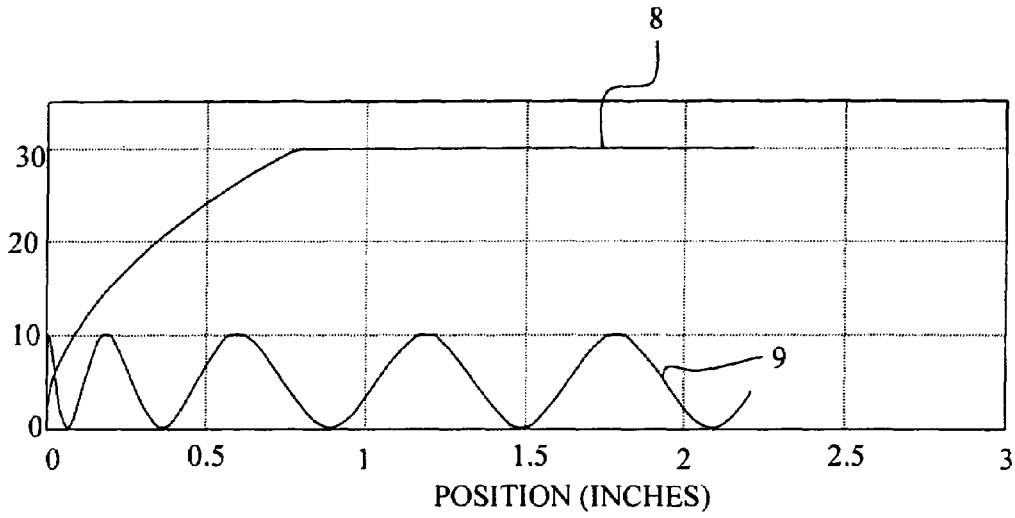
FIG. 1 graphically illustrates the general concept of a printhead carrier disturbance, in the form of a printhead carrier vibration.
Figure 2:
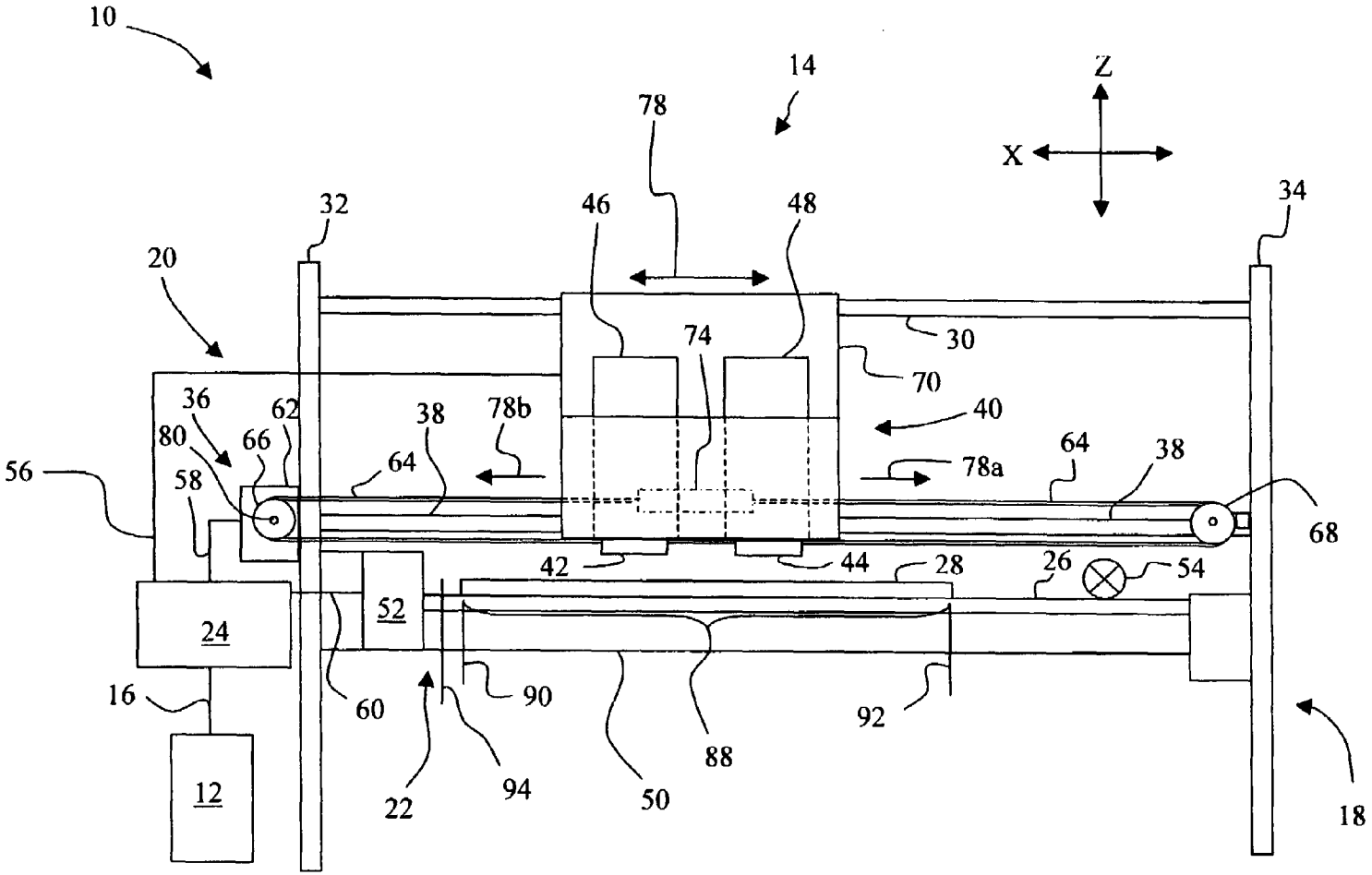
FIG. 2 is a diagrammatic depiction of an imaging system embodying the present invention.

Referring now to the drawings, and particularly to FIG. 2, there is shown a diagrammatic depiction of an imaging system 10 embodying the present invention. Imaging system 10 may include a host 12 and an imaging apparatus 14, or alternatively, imaging system 10 may be a standalone system not attached to a host.

Host 12, which may be optional, may be communicatively coupled to imaging apparatus 14 via a communications link 16. Communications link 16 may be established, for example, by a direct cable connection, wireless connection or by a network connection such as for example an Ethernet local area network (LAN).

In embodiments including host 12, host 12 may be, for example, a personal computer including an input/output (I/O) device, such as keyboard and display monitor. Host 12 further includes a processor, input/output (I/O) interfaces, memory, such as RAM, ROM, NVRAM, and may include a mass data storage device, such as a hard drive, CD-ROM and/or DVD units. During operation, host 12 includes in its memory a software program including program instructions that function as an imaging driver, e.g., printer driver software, for imaging apparatus 14. The imaging driver facilitates communication between host 12 and imaging apparatus 14, and may provide formatted print data to imaging apparatus 14. Alternatively, however, all or a portion of the imaging driver may be incorporated into imaging apparatus 14.

Imaging apparatus 14 may be, for example, a printer or a multifunction unit. Such a printer may be, for example, an ink jet printer having an ink jet print engine. Such a multifunction unit may include an ink jet print engine, and is configured to perform standalone functions, such as copying or facsimile receipt and transmission, or may be connected to host 12 via communications link 16 to facilitate a printing function.

Imaging apparatus 14, in the form of an ink jet printer, includes a frame 18, a printhead carrier system 20, a feed roller unit 22, a controller 24, and a mid-frame 26. Imaging apparatus 14 is configured to form an image, e.g., text and/or graphics, on a print medium 28, such as a sheet of paper, transparency or fabric. In embodiments including host 12, formatted print data may be provided to imaging apparatus 14 via communications link 16.

Frame 18 includes a cross member 30, a side frame 32, and a side frame 34, with mid-frame 26 extending between side frame 32 and side frame 34. Cross member 30 also extends between side frame 32 and side frame 34, and may be formed, for example, by providing a stamped metal plate defining a guide surface.

Printhead carrier system 20 includes a carrier drive system 36, a guide member 38, and a printhead carrier 40 that carries a color printhead 42, and a monochrome (e.g., black) printhead 44, for printing on print medium 28. Guide member 38, which may for example be in the form of a smooth metal rod, is coupled to frame 18 via side frame 32 and side frame 34. Each of cross member 30 and carrier guide member 38 support and guide printhead carrier 40, and are considered part of printhead carrier system 20.

A color ink reservoir 46 is provided in fluid communication with color printhead 42, and a monochrome ink reservoir 48 is provided in fluid communication with monochrome printhead 44. Color ink reservoir 46 and color printhead 42 may be combined to form a unitary color printhead cartridge. Likewise, monochrome ink reservoir 48 and monochrome printhead 44 may be combined to form a unitary monochrome printhead cartridge. Alternatively, color ink reservoir 46 and monochrome ink reservoir 48 may be located remote from printhead carrier 40, and respectively connected to their corresponding printheads 42, 44 via fluid conduits.

Feed roller unit 22 includes a feed roller 50 and corresponding idler pinch rollers (not shown). Feed roller 50 is driven for rotation by a drive unit 52. The pinch rollers apply a biasing force to hold print medium 28 in contact with the driven feed roller 50. Drive unit 52 includes a drive source, such as, for example, a direct current (DC) motor, or a stepper motor, and an associated drive mechanism, such as a gear train or belt/pulley arrangement. Feed roller unit 22 feeds print medium 28 in a sheet feed direction 54. As shown in FIG. 2, sheet feed direction 54 is depicted as an X within a circle to indicate that the sheet feed direction 54 is in a direction perpendicular to the plane of FIG. 2, toward the reader. Under the convention adopted for use in describing the present invention, sheet feed direction 54 is parallel to a Y-axis, and thus, sometimes may be referred to as the Y-direction.

Controller 24 is communicatively coupled to color printhead 42 and monochrome printhead 44 via an interface cable 56, such as a flexible ribbon cable. Controller 24 is communicatively coupled to carrier drive system 36 via an interface cable 58. Controller 24 is communicatively coupled to drive unit 52 via an interface cable 60.

Controller 24 includes digital signal processing capability, and may include a processor unit, memory and associated interface circuitry, and may be formed as an Application Specific Integrated Circuit (ASIC). The controller memory may include, for example, random access memory (RAM), read only memory (ROM), and/or non-volatile random access memory (NVRAM). Controller 24 executes program instructions to effect the printing of an image on print medium 28, such as coated paper, plain paper, photo paper, or transparency, while print medium 28 is supported by mid-frame 26, and is configured to control the operation of printhead carrier system 20 in accordance with the present invention to reduce the effects of printhead carrier disturbance during printing with imaging apparatus 14.

Carrier drive system 36 includes a carrier motor 62, a carrier drive belt 64, a carrier drive pulley 66, and an idler pulley 68. Printhead carrier 40 includes a carrier housing 70. A belt attachment assembly 74 is interposed between carrier drive belt 64 and carrier housing 70, and provides a mechanical interface between carrier drive belt 64 and carrier housing 70.

Printhead carrier 40 is guided by guide member 38 and cross member 30. Printhead carrier 40 is slidably coupled to guide member 38, and is slidably coupled to cross member 30. Guide member 38 defines a bi-directional main scanning direction 78 for printhead carrier 40. Bi-directional main scanning direction 78 is perpendicular to sheet feed direction 54. With reference to the arrangement of components shown in FIG. 2, a left-to-right movement of printhead carrier 40 along bi-directional main scanning direction 78 will be referred to as direction 78*a*, and a right-to-left movement of printhead carrier 40 along bi-directional main scanning direction 78 will be referred to as direction 78*b*. Under the convention used in describing the present invention, bi-directional main scanning direction 78, and specific directions 78*a* and 78*b*, are parallel to an X-axis, and thus, sometimes may be referred to X-direction 78, 78*a* and/or 78*b*.

Carrier drive belt 64 is driven by carrier motor 62 via carrier drive pulley 66, and is supported by an idler pulley 68. Carrier drive belt 64 serves to transmit translation to printhead carrier 40, via belt attachment assembly 74, in a reciprocating manner along guide member 38 and cross member 30 in bi-directional main scanning direction 78. Carrier motor 62 and idler pulley 68 may be mounted to frame 18. Carrier motor 62 may be, for example, a direct current (DC) motor or a stepper motor, and is coupled to carrier drive pulley 66 via a carrier motor shaft 80.

With reference to the arrangement of components shown in FIG. 2, a clockwise rotation of carrier drive pulley 66 results in an indirect application of force to belt attachment assembly 74 via carrier drive belt 64 and idler pulley 68, resulting in a left-to-right movement of printhead carrier 40 along bi-directional main scanning direction 78 in direction 78*a*. A counter-clockwise rotation of carrier drive pulley 66 results in a direct application of force to belt attachment assembly 74 via carrier drive belt 64, resulting in a right-to-left movement of printhead carrier 40 along bi-directional main scanning direction 78 in direction 78*b*.

During movement of printhead carrier 40, printhead carrier 40 may experience a printhead carrier disturbance, such as in the form of vibrations, and such vibrations may differ in frequency and/or amplitude depending on the direction of carrier travel. Such vibrations may result in dot placement errors in both the X-direction, i.e.,. direction 78, and in the Y-direction, i.e., in direction 54, which is perpendicular to the X-direction, and such dot placement errors show up in the printed image formed on print medium 28 in the form of vertical banding.

For example, it has been found in a printhead carrier system, such as printhead carrier system 20 including printhead carrier 40, one source of carrier vibration resulting in carrier induced dot placement error is a fixed frequency natural mode of printhead carrier system 20, which when excited may oscillate at a frequency, for example, of about 50 Hz. The actual frequency of the natural mode of a printhead carrier system will depend on a variety of factors, such as for example, the tolerances and quality of the components used in the printhead carrier system, and the mass of the printhead carrier and mounted printhead cartridges.

Figure 3A:
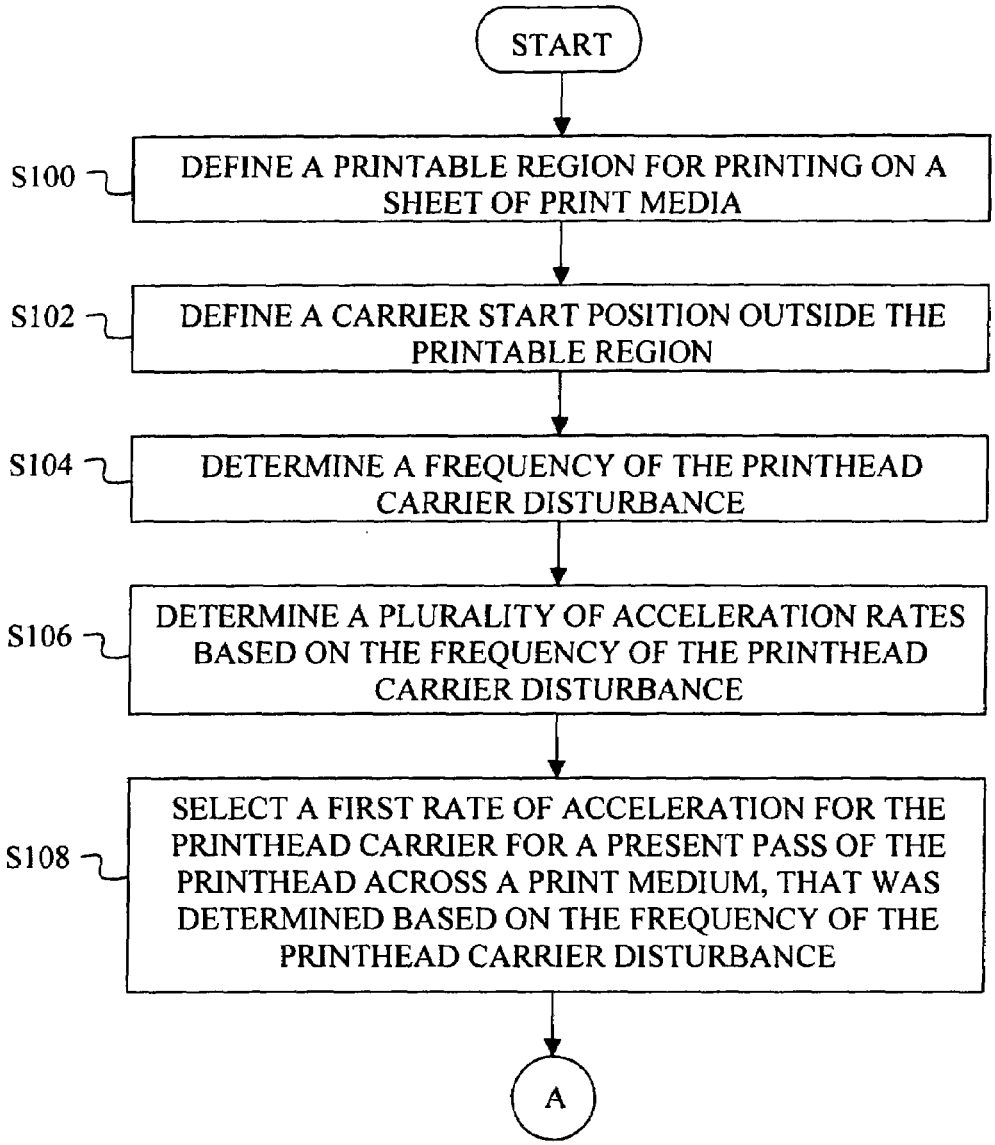
FIGS. 3A and 3B show a flowchart of a method in accordance with the present invention.
Figure 3B:
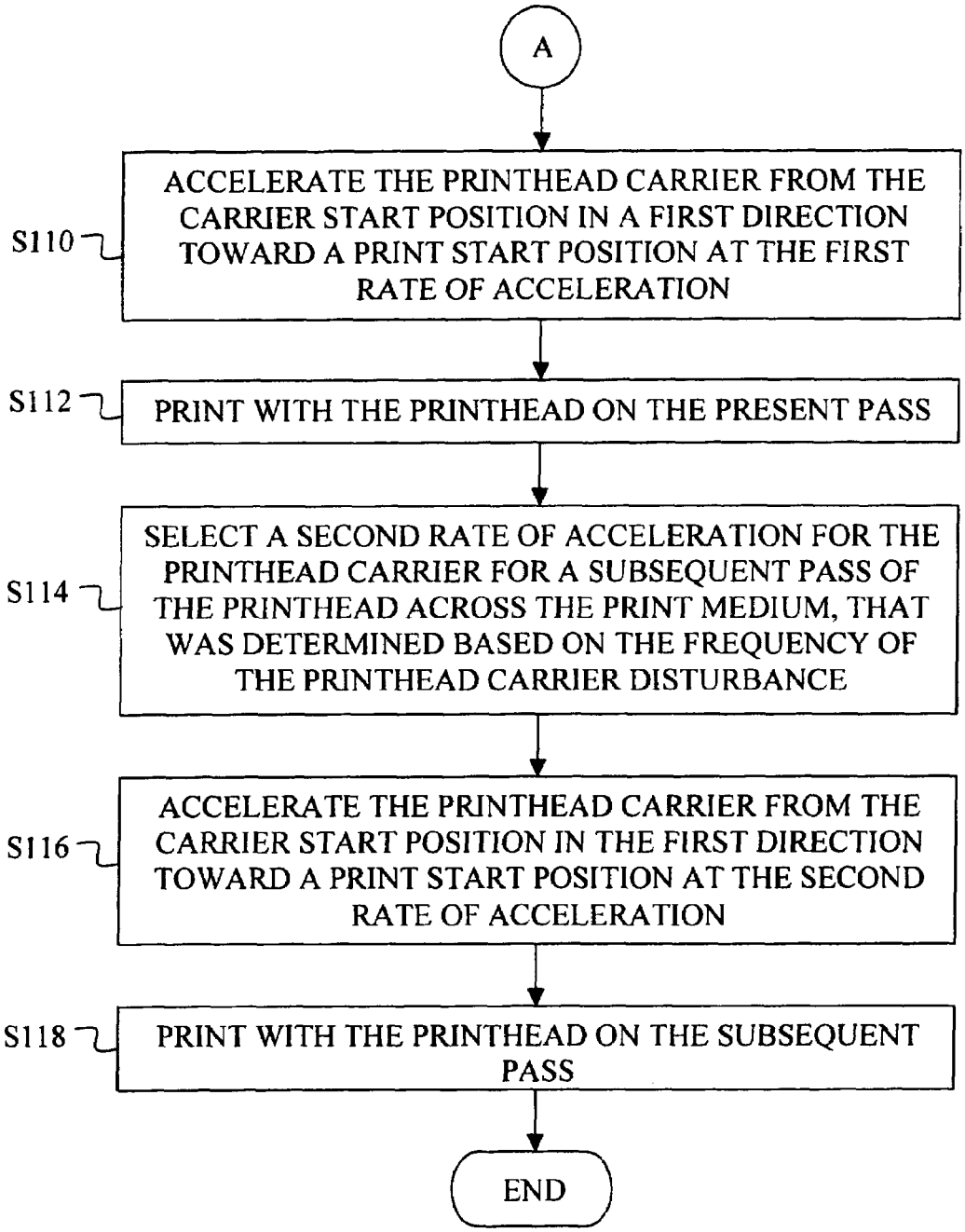

FIGS. 3A and 3B show a flowchart of a method in accordance with the present invention. For convenience, and without any intent to limit the scope of the invention, the method will be described with printing being effected by printhead 42. Controller 24 may be configured to execute program instructions to perform one or more of the method steps that follow.

Figure 4:
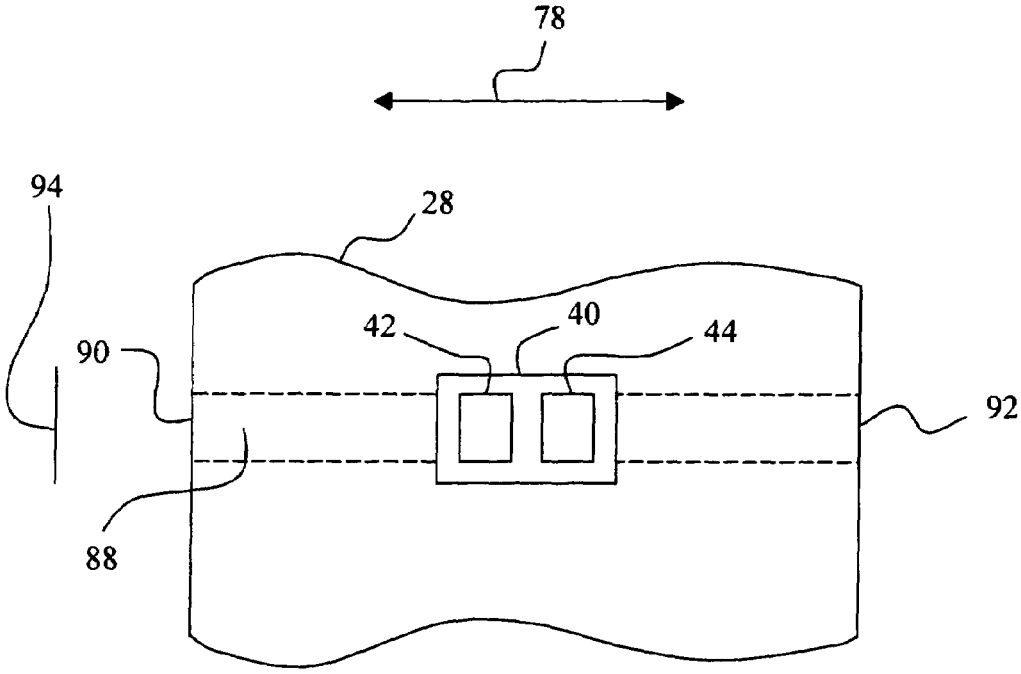
FIG. 4 is a diagrammatic representation of a printhead carrier scanning across a print medium during a printing pass.
Figure 5A:
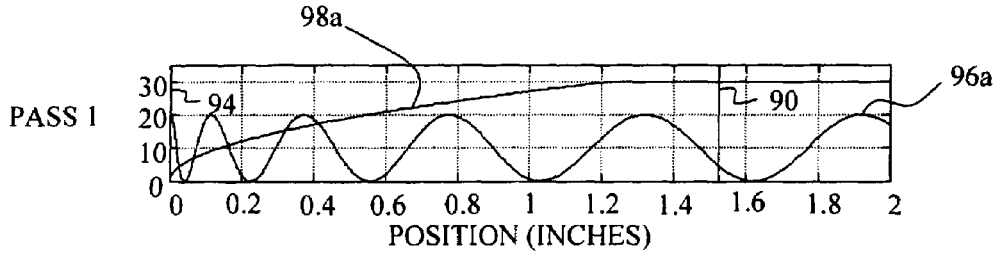
FIGS. 5A–5E graphically illustrate, for an exemplary eight pass shingling mode (four passes in each direction), four spatially phase shifted printhead carrier disturbance waveforms attributable to using four different rates of acceleration for a printhead carrier from a carrier start position in four successive printhead passes in the same direction.
Figure 5B:
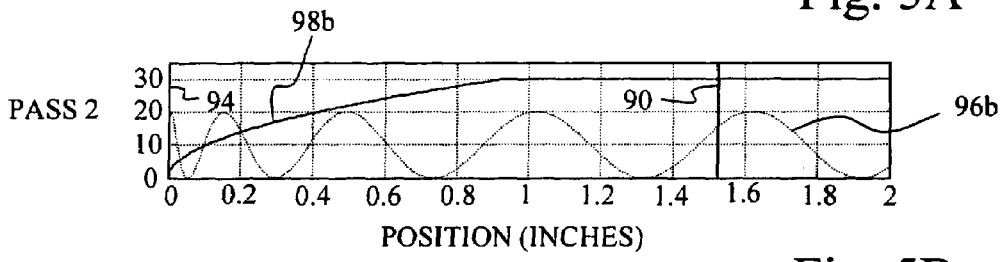
Figure 5C:
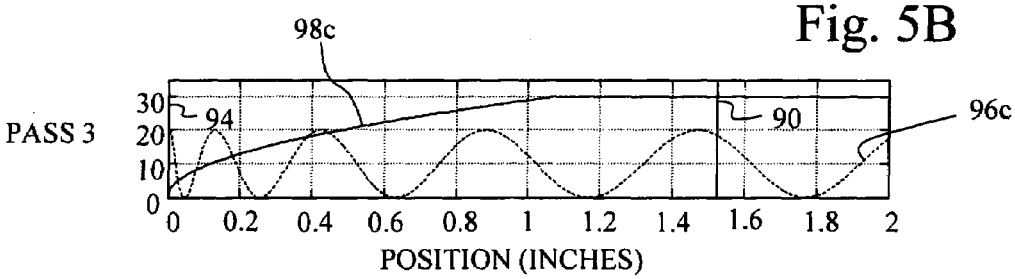
Figure 5D:
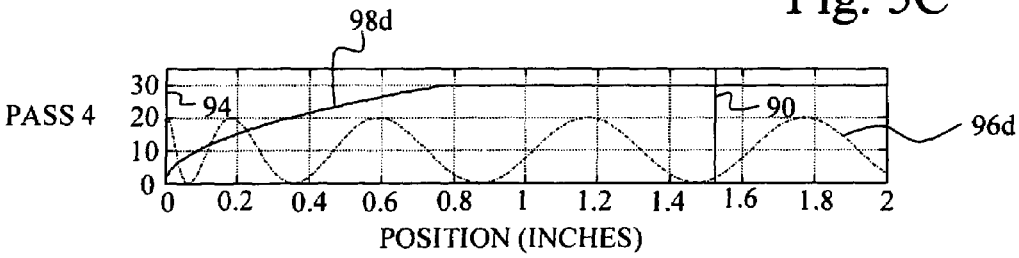
Figure 5E:
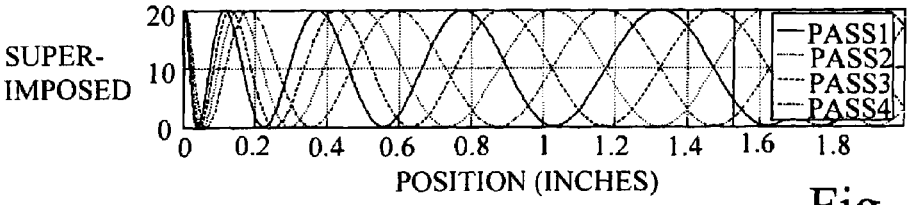

The method set forth in the flowchart of FIGS. 3A and 3B will be described below with respect to FIGS. 4 and 5A–5E. FIG. 4 is a diagrammatic representation of printhead carrier 40 scanning across print medium 28 during a printing pass. In FIGS. 5A–5D, waveforms 98*a*–98*d* depict printhead carrier velocities, in inches per second (ips), and waveforms 96*a*–96*d* depict the shifting, as a result of changing the rate of acceleration of printhead carrier 40 as shown in waveforms 98*a*–98*d*, respectively, of an exemplary printhead carrier disturbance represented in terms of generated dot placement error in microns (um) in the sub-scanning direction, i.e., the Y-direction, at a disturbance frequency of 50 hertz (Hz), i.e., having a period of 20 ms. FIG. 5E shows the superimposed printhead carrier disturbance waveforms 96*a*–96*d* of FIGS. 5A–5D, thereby demonstrating that the method of the present invention is effective in masking printhead carrier disturbance, such as a printhead carrier disturbance caused by a vibration of printhead carrier 40 at a natural mode frequency of printhead carrier system 20. Each of the exemplary waveforms 96*a*–96*d* and 98*a*–98*d* is shown with respect to a position, in inches, along bi-directional main scanning direction 78, beginning at carrier start position 94.

At step S100, a printable region 88 (see FIGS. 2 and 4) for a sheet of print media, e.g., print medium 28, is defined. Printable region 88 may be defined, for example, by the boundaries of print medium 28 in the main scanning direction 78 with respect to the height of the printhead, e.g., printhead 42. Printable region 88 may include, for example, a print start position 90 and a print end position 92. Thus, print start position 90 and print end position 92 define an extent of the printable region 88 in main scanning direction 78 of printhead carrier 40. As shown, the print start position 90 and a print end position 92 are located with reference to a left-to-right pass of printhead carrier 40; however, for a right-to-left pass of printhead carrier 40, the positions of print start position 90 and a print end position 92 would be reversed from that shown in FIG. 2.

At step S102, a carrier start position 94 is defined at a location outside printable region 88, and is closer to print start position 90 than to print end position 92. Carrier start position 94 may be an arbitrary location selected so as to accommodate the plurality of selectable rates of acceleration for printhead carrier 40 in reaching a steady state printhead carrier velocity, for example, at or prior to print start position 90. One example would be to accommodate a slowest of the plurality of selectable rates of acceleration. In some implementations, however, print start position 90 may be reached prior to reaching the steady state velocity.

At step S104, a frequency of the printhead carrier disturbance (e.g., see waveform 96*a* of FIG. 5A) for printhead carrier system 20 is determined. The frequency may be determined, for example, by printing a test pattern, and then measuring the test pattern to determine the frequency of the printhead carrier disturbance experienced by printhead carrier 40. Measuring may be performed manually, or may be performed automatically by using a scanner and pattern recognition software, which is programmed to recognize cyclical patterns in the printed test pattern. In the exemplary waveforms of FIGS. 5A–5E, the frequency of the printhead carrier disturbance is 50 Hz.

At step S106, a plurality of acceleration rates are determined, which are based on the frequency of the printhead carrier disturbance determined in step S104. For example, the plurality of acceleration rates may each be different, and may be selected to cause a phase shift of the printhead carrier disturbance frequency in a subsequent printing pass in a particular direction, e.g., direction 78*a*, relative to a previous printing pass in the same direction, i.e., direction 78*a*.

As an example, FIGS. 5A–5D show, for an eight pass shingling mode, spatially phase shifted printhead carrier disturbance waveforms 96*a*, 96*b*, 96*c* and 96*d* attributable to using four different rates of acceleration (see acceleration plots 98*a*, 98*b*, 98*c* and 98*d*) respectively associated with one of the four printing passes in a particular direction, such as one of directions 78*a* and 78*b*. Accordingly, in this example, each of PASS 1, PASS 2, PASS 3 and PASS 4 occur with printhead carrier 40 traveling in one direction, e.g., direction 78*a*. For ease of understanding the present invention, the return passes in direction 78*b* are not depicted. In the example shown, the rate of acceleration for PASS 2 is greater than PASS 1 and PASS 3, but less than PASS 4; the rate of acceleration for PASS 3 is greater than PASS 1, but less than PASS 2 and PASS 4; and the rate of acceleration for PASS 4 is greater than PASS 1, PASS 2 and PASS 3.

Referring to FIGS. 5A–5E, the vertical line at position 0 inches represents carrier start position 94, and the vertical line between positions 1.4 and 1.6 inches represents a particular print position on the page, which may be, for example, print start position 90, or may be some other arbitrary reference location. As shown, print start position 90 represents a predetermined fixed position common to each of the passes in a particular direction, e.g., PASS 1, PASS 2, PASS 3 AND PASS 4. Likewise, carrier start position 94 represents a predetermined fixed position common to each of the passes in a particular direction, e.g., PASS 1, PASS 2, PASS 3 AND PASS 4. As shown, each of the four passes is shifted in order to evenly distribute the sinusoidal errors of the carrier disturbance. In one preferred embodiment, as illustrated, the shift amounts are in non-sequential order, for example, 0, ½, ¼ and ¾ of the period of the frequency of the carrier disturbance (i.e. providing 0, 180, 90, and 270 degrees phase shift) so as to reduce the appearance of print defects.

In this example, the frequency of the carrier disturbance is 50 Hz, thus the printhead carrier disturbance has a period of 1/50=20 milliseconds (ms). Accordingly, in order to shift the phase by 0, ½, ¼, and ¾ of the period of the carrier disturbance, a time required for printhead carrier 40 to travel from carrier start position 94 to print start position 90 is varied by 0 ms, 10 ms, 5 ms, and 15 ms, respectively, in PASS 1, PASS 2, PASS 3 and PASS 4, respectively. Therefore, for example, assuming a distance from carrier start position 94 to print start position 90 of 1.5250 inches and a printhead carrier steady state velocity of 30 inches/second, then acceleration rates of 0.9476, 1.2535, 1.0793, and 1.5 g are required. The phase of the disturbance vibration is given by the equation:

$$\phi = \frac{\mathrm{mod}(t_t, T_d)}{T_d} * 360$$

where $\phi$ is the phase (in degrees), $t_t$ is the total time to reach the reference point or print start position 90, $T_d$ is the period of the disturbance vibration, and mod is the modulus function (remainder after division). The total time from carrier start position 94 to reach the reference position, e.g., print start position 90, is given by the equation:

$$t_t = \frac{v_{SS}}{a} + \frac{\langle d_r - d_a \rangle}{v_{SS}}$$

$$d_a = \frac{v_{SS}^2}{2a}$$

where $v_{ss}$ is the printhead carrier steady state velocity, a is the carrier acceleration rate, $d_r$ is the known distance from carrier start position 94 to the reference point, e.g., print start position 90, and $d_a$ is the distance required to accelerate. As shown in FIGS. 5A–5D, regardless of the rate of acceleration for printhead carrier 40 for each of the passes in a particular direction, the printhead carrier steady state velocity is the same.

The plurality of acceleration rates may be stored, for example, in the memory of controller 24, or alternatively, in host 12, if present.

At step S108, there is selected a first rate of acceleration for printhead carrier 40 from the plurality of acceleration rates for a present pass of printhead 42 across print medium 28, e.g., a sheet of print media, that was determined based on the frequency of the printhead carrier disturbance.

At step S110, on a present pass of printhead 42 across print medium 28, printhead carrier 40 is accelerated from carrier start position 94 in the first direction, e.g., direction 78*a*, toward print start position 90 at the first rate of acceleration.

At step S112, a portion of an image is printed on print medium 28 with printhead 42 on the present pass.

At step S114, there is selected a second rate of acceleration for printhead carrier 40 from the plurality of acceleration rates for a subsequent pass of printhead 42 across print medium 28, which was determined based on the frequency of the printhead carrier disturbance.

At step S116, on a subsequent pass of printhead 42 across print medium 28, printhead carrier 40 is accelerated from carrier start position 94 in the first direction, e.g., direction 78*a*, toward print start position 90 at the second rate of acceleration.

At step S118, another portion of the image is printed on print medium 28 with printhead 42 on the subsequent pass.

If desired, controller 24 may execute instructions to control feed roller unit 22 to advance the print medium 28 in sheet feed direction 54 between the present pass of printhead 42 in step S110 and the subsequent pass of printhead 42 at step S116.

Steps S116 and S118 may be repeated as necessary to accommodate a particular print shingling mode. For example, if eight pass shingling is being used in generating the printed image, then four passes will be in one direction, e.g., direction 78*a*, of bi-directional main scanning direction 78, and four passes with be in the opposite direction, e.g., direction 78*b*, of bi-directional main scanning direction 78. Of the four passes in a particular direction, each will have associated therewith a rate of acceleration that will differ from the rate of acceleration for the preceding pass and/or the rate of acceleration for a subsequent pass.

As shown in FIG. 5E, the superimposed printhead carrier disturbance waveforms of FIGS. 5A–5D demonstrate that the method of the present invention is effective in masking printhead carrier disturbance, such as a printhead carrier disturbance caused by a vibration of printhead carrier 40 at a natural mode frequency of printhead carrier system 20, and thereby reduces the effects of printhead carrier disturbance on printing quality, such as for example, by reducing or eliminating vertical banding in the printed image.

Those skilled in the art will recognize that the order of the selected rates of acceleration for the four passes of the example of FIGS. 5A–5E may be changed, as desired, to achieve the most desirable printing result. Also, those skilled in art will recognize that the principles of the present invention may be easily adapted for use in printing modes that have more or less printing passes than in the eight-pass example described above. Still further, those skilled in art will recognize that the principles of the present invention may be easily adapted for use in either or both of printing directions 78*a*, 78*b*.

While this invention has been described with respect to particular embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for reducing the effects of printhead carrier disturbance during printing with an imaging apparatus having a printhead carrier for carrying at least one printhead, comprising the steps of:

accelerating said printhead carrier from a first position in a first direction;

printing with said printhead in said first direction; and changing a rate of acceleration of said printhead carrier for a subsequent accelerating of said printhead carrier from said first position in said first direction prior to a subsequent printing with said printhead in said first direction to phase shift said printhead carrier disturbance.

2. The method of claim 1, said rate of acceleration being determined based on a frequency of said printhead carrier disturbance.

3. The method of claim 1, wherein said first position is a carrier start position.

4. The method of claim 1, wherein said rate of acceleration for said subsequent accelerating of said printhead carrier is greater than a previous rate of acceleration of said printhead carrier.

5. The method of claim 1, wherein said rate of acceleration for said subsequent accelerating of said printhead carrier is less than a previous rate of acceleration of said printhead carrier.

6. The method of claim 1, said printhead carrier being accelerated from said first position in said first direction to achieve a same steady state velocity, regardless of said rate of acceleration.

7. The method of claim 1, wherein said first direction is one of two opposing directions of a bi-directional main scanning direction of said printhead carrier.

8. A method for reducing the effects of printhead carrier disturbance during printing with an imaging apparatus having a printhead carrier for carrying at least one printhead, comprising the steps of:

on a present pass of said printhead across a print medium, accelerating said printhead carrier from a first position in a first direction at a first rate of acceleration;

printing with said printhead on said present pass;

on a subsequent pass of said printhead across said print medium, accelerating said printhead carrier from said first position in said first direction at a second rate of acceleration different from said first rate of acceleration; and printing with said printhead on said subsequent pass.

9. The method of claim 8, selecting said first rate of acceleration and said second rate of acceleration to phase shift said printhead carrier disturbance.

10. The method of claim 8, said first rate of acceleration and said second rate of acceleration being determined based on a frequency of said printhead carrier disturbance.

11. The method of claim 8, wherein said first position is a carrier start position.

12. The method of claim 8, wherein said second rate of acceleration is greater than said first rate of acceleration.

13. The method of claim 8, wherein said second rate of acceleration is less than said first rate of acceleration.

14. The method of claim 8, said printhead carrier being accelerated from said first position in said first direction to achieve a same steady state velocity on each of said present pass and said subsequent pass.

15. A method for reducing the effects of printhead carrier disturbance during printing with an imaging apparatus having a printhead carrier for carrying at least one printhead, comprising the steps of:

defining a printable region for printing on a print medium, said printable region having a print start position and a print end position, said print start position and said print end position defining an extent of said printable region in a main scanning direction of said printhead carrier;

defining a carrier start position outside said printable region;

on a present pass of said printhead across said print medium, accelerating said printhead carrier from said carrier start position in a first direction toward said print start position at a first rate of acceleration;

printing with said printhead on said present pass;

on a subsequent pass of said printhead across said print medium, accelerating said printhead carrier from said carrier start position in said first direction toward said print start position at a second rate of acceleration different from said first rate of acceleration; and printing with said printhead on said subsequent pass.

16. The method of claim 15, wherein said printhead carrier reaches a steady state velocity at said print start position.

17. The method of claim 15, further comprising the step of:

determining a frequency of said printhead carrier disturbance; and said first rate of acceleration and said second rate of acceleration being determined based on said frequency of said printhead carrier disturbance to phase shift said printhead carrier disturbance.

18. The method of claim 15, said printhead carrier being accelerated from said carrier start position in said first direction to achieve a same steady state velocity on each of said present pass and said subsequent pass.

19. The method of claim 15, said printhead carrier being accelerated from said carrier start position toward a predetermined fixed position in said first direction to achieve a same steady state velocity on each of said present pass and said subsequent pass.

20. The method of claim 19, said predetermined fixed position being said print start position.

21. An imaging apparatus, comprising:

a printhead carrier system configured to drive a printhead carrier carrying at least one printhead along a bi-directional main scanning direction across a print medium; and a controller communicatively coupled to said printhead carrier system, said controller executing instructions to perform the steps of:

on a present pass of said printhead across said print medium, accelerating said printhead carrier from a first position in a first direction at a first rate of acceleration;

printing with said printhead on said present pass;

on a subsequent pass of said printhead across said print medium, accelerating said printhead carrier from said first position in said first direction at a second rate of acceleration different from said first rate of acceleration; and printing with said printhead on said subsequent pass.

22. The imaging apparatus of claim 21, further comprising a feed roller unit communicatively coupled to said controller, said controller executing instructions to perform the step of controlling said feed roller unit to advance said print medium in a sheet feed direction between said present pass of said printhead and said subsequent pass of said printhead.

23. The imaging apparatus of claim 21, said controller executing instructions to perform the step of selecting said first rate of acceleration and said second rate of acceleration to phase shift a printhead carrier disturbance.

24. The imaging apparatus of claim 23, wherein said phase shift of said printhead carrier disturbance is by one of ¼, ½, and ¾ of a period of said printhead carrier disturbance.

25. The imaging apparatus of claim 23, wherein for four consecutive passes of said printhead across said print medium in said first direction, said phase shift of said printhead carrier disturbance is in the order of 0, ½, ¼, and ¾, respectively, of a period of said printhead carrier disturbance.

26. The imaging apparatus of claim 21, said first rate of acceleration and said second rate of acceleration being determined based on a frequency of a printhead carrier disturbance.

27. The imaging apparatus of claim 21, wherein said first position is a carrier start position.

28. The imaging apparatus of claim 21, wherein said second rate of acceleration is greater than said first rate of acceleration.

29. The imaging apparatus of claim 21, wherein said second rate of acceleration is less than said first rate of acceleration.

30. The imaging apparatus of claim 21, said printhead carrier being accelerated from said first position in said first direction to achieve a same steady state velocity on each of said present pass and said subsequent pass.

31. The imaging apparatus of claim 30, said printhead carrier being accelerated from said first position toward a predetermined fixed position common to each of said present pass and said subsequent pass.

32. The imaging apparatus of claim 31, said first position being a carrier start position and said predetermined fixed position being a print start position.

33. The imaging apparatus of claim 21, wherein the accelerating steps and the printing steps are repeated for a second direction opposite to said first direction.

* * * * *